US006601303B2

(12) United States Patent
Gilder et al.

(10) Patent No.: US 6,601,303 B2
(45) Date of Patent: Aug. 5, 2003

(54) SAFETY RAZORS

(75) Inventors: Bernard Gilder, Tywford (GB); Paul Warrick, Reading (GB)

(73) Assignee: The Gillette Company, Boston, MA (US)

( * ) Notice: Subject to any disclaimer, the term of this patent is extended or adjusted under 35 U.S.C. 154(b) by 64 days.

(21) Appl. No.: 09/524,911

(22) Filed: Mar. 14, 2000

(65) Prior Publication Data

US 2002/0035786 A1 Mar. 28, 2002

Related U.S. Application Data

(63) Continuation of application No. PCT/GB98/02732, filed on Sep. 10, 1998.

(30) Foreign Application Priority Data

Sep. 18, 1997 (GB) ..... 9719926
Jul. 13, 1998 (GB) ..... 9815156

(51) Int. Cl.[7] ..... B26B 21/14
(52) U.S. Cl. ..... 30/50; 30/77
(58) Field of Search ..... 30/34.2, 50, 77, 30/81, 82

(56) References Cited

U.S. PATENT DOCUMENTS 3,088,206 A * 5/1963 Muros ..... 30/77
3,871,076 A * 3/1975 Perry ..... 30/77
3,871,077 A * 3/1975 Nissen et al. ..... 30/77
5,056,222 A * 10/1991 Miller et al. ..... 30/77
5,067,238 A 11/1991 Miller et al.
5,092,042 A * 3/1992 Miller et al. ..... 30/77
5,191,712 A 3/1993 Crook et al.
5,224,267 A * 7/1993 Simms et al. ..... 30/50
5,249,361 A 10/1993 Apprille et al.
5,551,153 A * 9/1996 Simms ..... 30/50
5,689,883 A * 11/1997 Ortiz et al. ..... 30/34.2
5,711,076 A 1/1998 Yin et al.
5,761,814 A * 6/1998 Anderson et al. ..... 30/50
5,794,343 A * 8/1998 Lee et al. ..... 30/50
5,915,791 A * 6/1999 Yin et al. ..... 30/41

FOREIGN PATENT DOCUMENTS

WO WO-92/17322 10/1992
WO WO-96/01171 1/1996

* cited by examiner

*Primary Examiner*—Allan N. Shoap
*Assistant Examiner*—Stephen Choi
(74) *Attorney, Agent, or Firm*—Charles P. Boukus, Jr.; Donal B. Tobin

(57) ABSTRACT

A safety razor blade unit has a guard structure (5) which includes a strip (10) of elastomeric material e.g. with projections such as fins (12) or tubes (35), and a backstop (13) disposed between the elastomeric strip (10) and the edge (20) of a leading blade (2), the backstop including a rigid wall (15) integrally moulded with the blade unit housing (1) and a resiliently deformable portion (17) integral with the elastomeric strip (10) and adapted to yield under forces experienced during shaving by being compressed against the rigid wall (15) or flexing downwardly.

16 Claims, 5 Drawing Sheets h = 0.20mm
e = −0.14mm
BTA = 6.6°
$S_1$ = 0.70mm
$S_2$ = 1.50mm h = 0.70mm
e = −0.05mm
BTA = 16.8°
$S_1$ = 0.70mm
$S_2$ = 1.50mm

SAFETY RAZORS

This is a continuation of International Application No. PCT/GB98/02732 with an international filing date of Sep. 10, 1998.

This invention relates to shaving devices and concerns a safety razor blade unit having at least one blade with a cutting edge which is moved across the surface of the skin being shaved by means of a handle to which the blade unit is attached. The blade unit may be mounted detachably on the handle to enable the blade unit to be replaced by a fresh blade unit when the blade sharpness has diminished to an unsatisfactory level, or it may be attached permanently to the handle with the intention that the entire razor be discarded when the blade or blades have become dulled. Razor blade units generally include a guard which defines a surface for contacting the skin in front of the blade(s) and a cap for contacting the skin behind the blade(s), the cap and guard serving important roles in establishing the so-called "shaving geometry", i.e. the parameters which determine the blade orientation and position relative to the skin during shaving. The present invention is especially concerned with the guard structure of a razor blade unit.

It is known to include in a guard structure an elastomeric strip with a surface configuration intended to produce pleasant tactile sensations on contact with the skin during shaving, for example as described in U.S. Pat. No. 5,191,712, and/or to interact with the hairs in a favourable manner immediately before they are cut by a blade of the blade unit moving across the skin and following the guard structure. The surface configuration of the elastomeric strip can take a variety of different forms, including upstanding discrete projections e.g. tubes or crescent-shaped projections, or fins either extending parallel to the blade edge or transverse thereto. A form of elastomeric strip incorporated in currently marketed blade units has a series of, e.g. 4 or 5, parallel fins extending lengthwise of the blade unit. The present invention is particularly described herein with reference to a strip of this latter form, and to an alternative strip construction incorporating upstanding tubes of D-shape cross-section, but it should be understood that the invention is equally applicable to guard structures with elastomeric strips with any other surface configuration for interaction with the skin and/or hairs. Other forms of elastomeric strip are described for example in U.S. patent application Ser. No. 09/113,460, filed Jul. 10, 1998 (which corresponds to WO97/25190) and U.S. patent application Ser. No. 09/141,436, filed Aug. 27, 1998, issued as U.S. Pat. No. 6,298,557 (which corresponds to WO97/33729), the contents of which are incorporated herein by reference.

When an elastomeric strip is included in the guard structure of a razor blade unit it is usual to provide between the elastomeric strip and the adjacent blade edge a so-called "backstop" which is a rigid part having an upper surface for contact with the skin. The backstop is important in establishing certain parameters of the geometry, most notably the exposure of the blade, or the leading blade where two or more blades are incorporated in the blade unit. The blade exposure is the distance by which the blade projects beyond a plane which is tangential to the skin contacting surfaces immediately in front of and behind the blade edge. It is well known to provide a blade unit with moving parts so that the blade geometry is dynamically modified during shaving. For example, a blade can be mounted to move in response to forces exerted on the blade during shaving. It is also known to arrange for the rigid backstop to move downwardly under forces exerted on it by the skin during shaving so that the blade exposure tends to increase as load forces imparted on the guard structure increase. However, the need to mount the backstop movably in the housing or frame of the blade unit, and the need to provide return springs to urge the backstop to a normal rest position, complicate the blade unit manufacture and increase production costs.

In accordance with one aspect of the present invention there is provided a guard structure for a safety razor blade unit which has a rigid plastic housing to provide support for at least one blade and a cap structure, the guard structure including; a strip of elastomeric material; and a backstop disposed between the elastomeric strip and a leading blade edge, the backstop comprising a deformable portion capable of yielding resiliently under forces experienced during shaving. Most conveniently the deformable portion is integral with the elastomeric strip. It is preferred that the deformable portion is supported against displacement in a direction towards the leading blade edge by a rigid part of the backstop, which rigid part can be integral with the blade unit housing and may have the form of a wall with a front face and a top face adjoining the front face, the deformable portion being located above the top face and being connected to the elastomeric strip by a part extending upwardly in contact with at least an upper portion of the front face of the wall.

The deformable portion may be arranged to yield by being compressed, for example between the rigid wall and the skin being shaved. In a presently preferred construction, however, the deformable portion yields by flexing. More especially the deformable portion comprises a lip supported at a forward edge thereof and free to flex downwardly under shaving forces. The lip extends rearwardly from an upwardly directed support portion which connects the lip to the elastomeric strip, the trailing edge of the lip being free. Downward deflection of the lip is limited by a stop which is conveniently defined by the rigid wall of the blade unit housing.

By the invention all the benefits of a movable backstop can be secured without the disadvantages of having to provide a moving rigid part and return springs.

A full understanding of the invention will be gained from the following detailed description of some specific embodiments, reference being made to the accompanying drawings in which.

Figure 1:
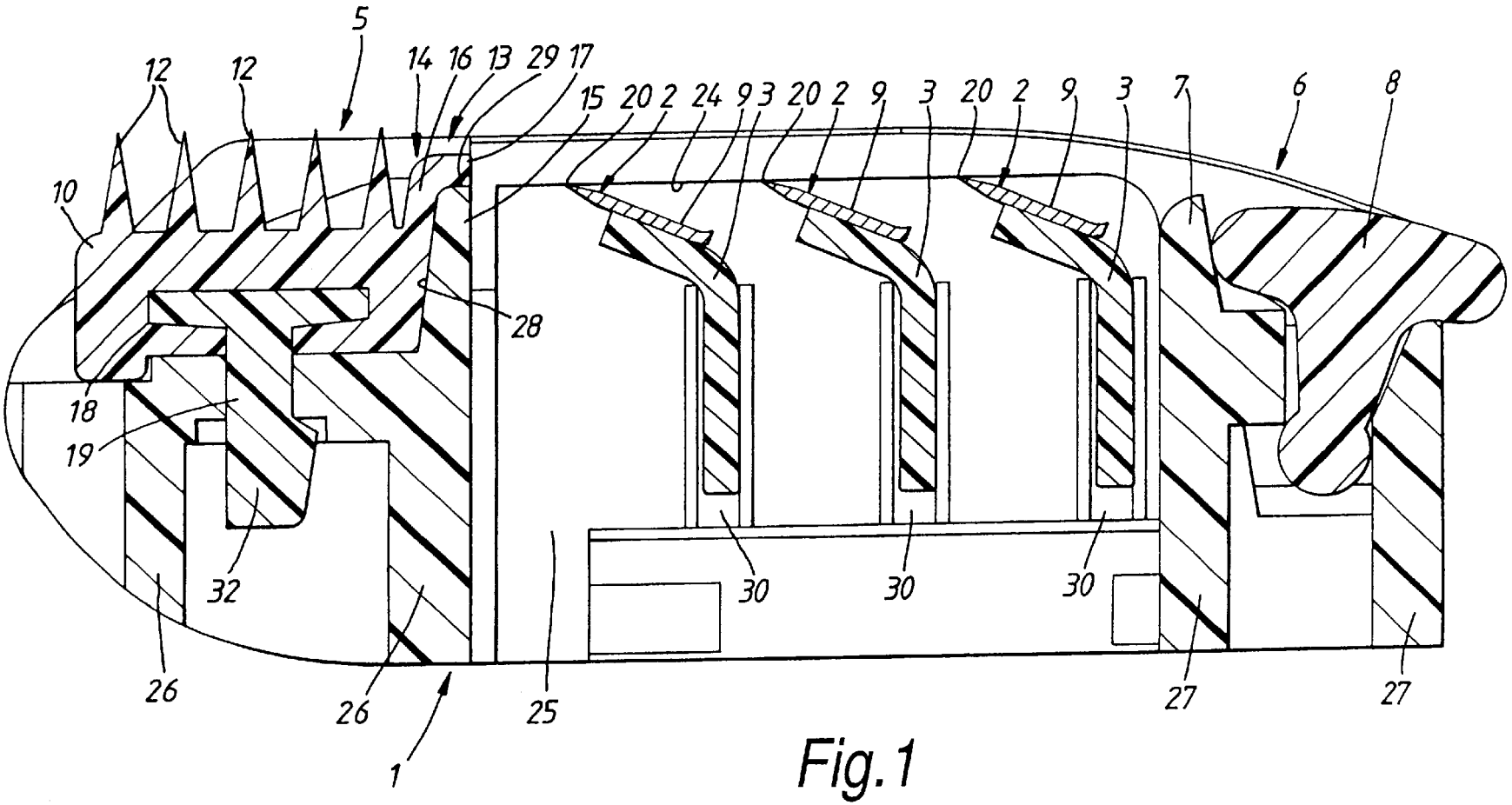
FIG. 1 is a cross-section through a safety razor blade unit incorporating a guard structure according to the invention.

Illustrated in FIG. 1 is a safety razor blade unit which is intended to be replaceably mounted on a handle. Blade units of this general type are commonly referred to as "cartridges". The blade unit or cartridge may be fixedly mounted on the handle or it can be pivotable about an axis which extends parallel to the blade edges. The illustrated blade unit comprises a generally rectangular blade housing or frame 1 moulded from rigid plastics material and having end walls 25 interconnected by front and rear members 26, 27. Mounted in the frame for movement independently of each other are three blades 2 with sharpened forward edges 20 and carried on respective blade supports 3 guided in slots 30 defined on the end walls of the frame. The blade supports 3, and hence the blades 2, are movable downwardly against the action of springs (not shown), the upward movement of the blades due to the springs being limited by abutment of the blades 2 with shoulders 24 on the end walls 25 of the frame 1. The blade unit includes a guard structure 5 and a cap structure 6 for respectively contacting the skin in front of and behind the blades during shaving. The cap structure includes a bar 7 integral with the frame and a lubricating strip 8 of a kind well known in the wet shaving art. Suitable materials for the lubricating strip 8 are those described in our U.S. Pat. No. 5,113,585 the contents of which are incorporated herein by reference.

The guard structure 5 includes an elastomeric strip 10 with a series of five upstanding parallel fins 12 which extend longitudinally of the blade unit in parallel with the blade edges 20, and a backstop 13.

The material of the elastomeric is chosen to provide an appropriate flexibility of the fins 12 so as to produce a desirable tactile sensation during shaving. Suitable materials for the elastomeric strip are those having a hardness value in the range of 27 to 75 on the Shore A scale and specific materials having appropriate characteristics include (i) Kraton G2705 having a hardness of 55 on the Shore A scale manufactured by the Shell Corporation, (ii) Evoprene #966 having a Shore A hardness value of 27 and distributed by Gary Chemical Corporation of Leominster, Mass., (iii) Santoprene 271-55 having a Shore A hardness value of 55 and manufactured by Advanced Elastomerics Corporation and (iv) Santoprene 271-73 having a Shore A hardness value of 73 and also manufactured by Advanced Elastomerics Corporation.

As so far described the blade unit construction of FIG. 1 is known. According to the present invention the backstop 13 is defined by an upwardly extending rigid wall 15 integrally moulded with the front member 26 of the frame 1, and an element of elastomeric material 14 made of the same material as and integrally moulded with the elastomeric strip 10. The element 14 includes an upstanding portion 16 which is in supporting abutment against the front face 28 of the wall 15, and a resiliently deformable portion 17 which in this embodiment has the form of a lip or pad and extends over and is in contact with the top face 29 of the wall 15. The elastomeric strip 10 is moulded onto a support platform 18 from which project two or more pegs 19 spaced along the platform 18, these pegs 19 being inserted through holes provided in a flat part of the front member 26 of the frame 1 and the pegs 19 having enlarged heads 32 at their free ends, to secure the platform 18 and elastomeric strip 10 securely to the frame 1.

Under load forces imparted against the surface of the lip 17 in the direction downwardly towards the rigid wall 15, the lip 17 is compressible to reduce the height of the backstop 13. This allows the shaving geometry, in particular the exposure of the first blade 2, either to vary during shaving or, for example when the blade 2 is movable, to be maintained, as desired.

Figure 2:
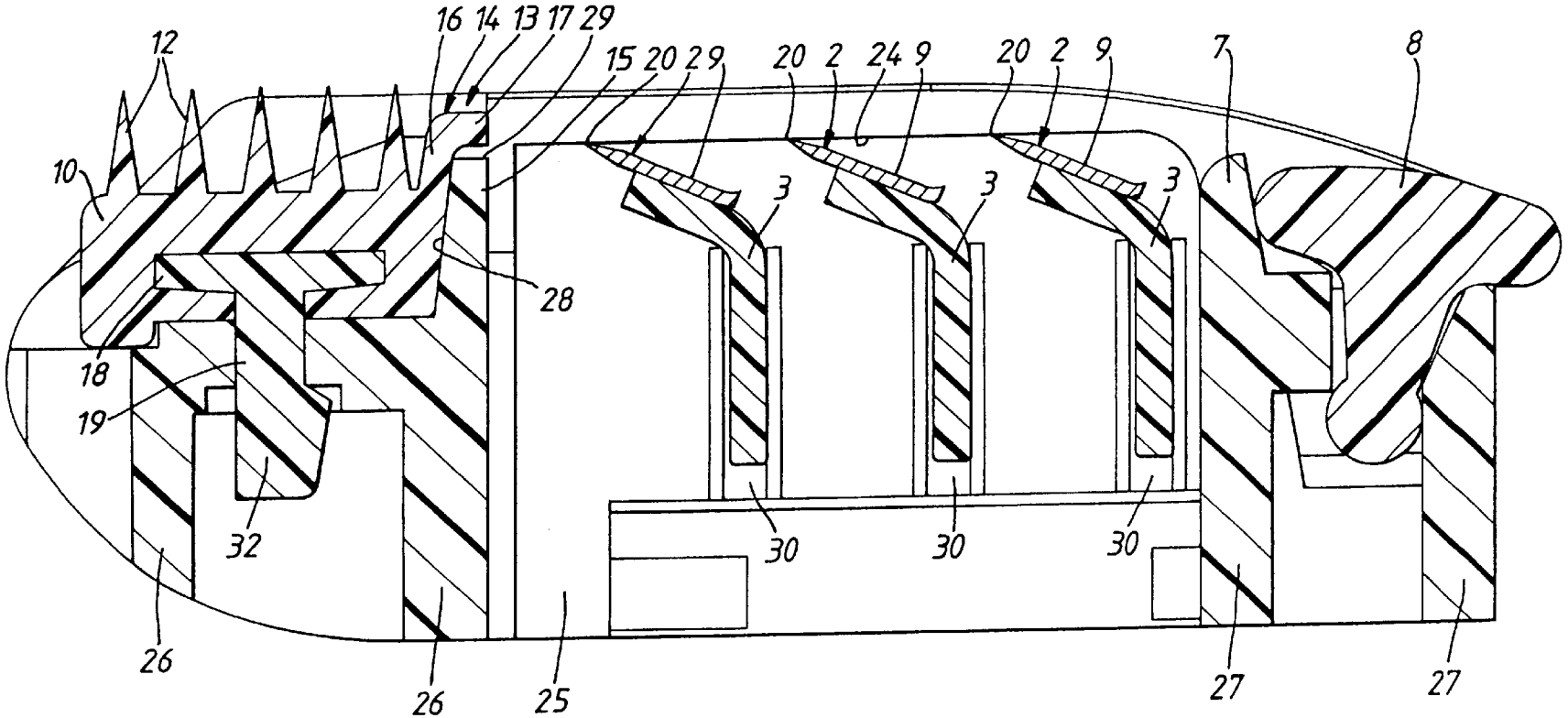
FIG. 2 is a cross-section through a second safety razor blade unit with a guard structure embodying the invention.

The embodiment of the invention shown in FIG. 2 is for the most part the same as that described above and shown in FIG. 1. It differs, however, in that the rigid wall 15 has a reduced height and the resiliently deformable lip 17 of elastomeric material is supported by the portion 16 at a position spaced above the top face 29 of the wall 15. By being supported by its front edge with its rear or trailing edge being free, the lip 17 is free to deflect by flexing resiliently downwardly under forces exerted on the lip 17 during shaving, and as a result may be more responsive to downwardly directed load forces. The rigid wall 15 provides a stop to limit the flexing movement of the lip, but it may continue to deform compressively after it has been brought into abutment with the top surface 29 of the wall 15.

Figure 3:
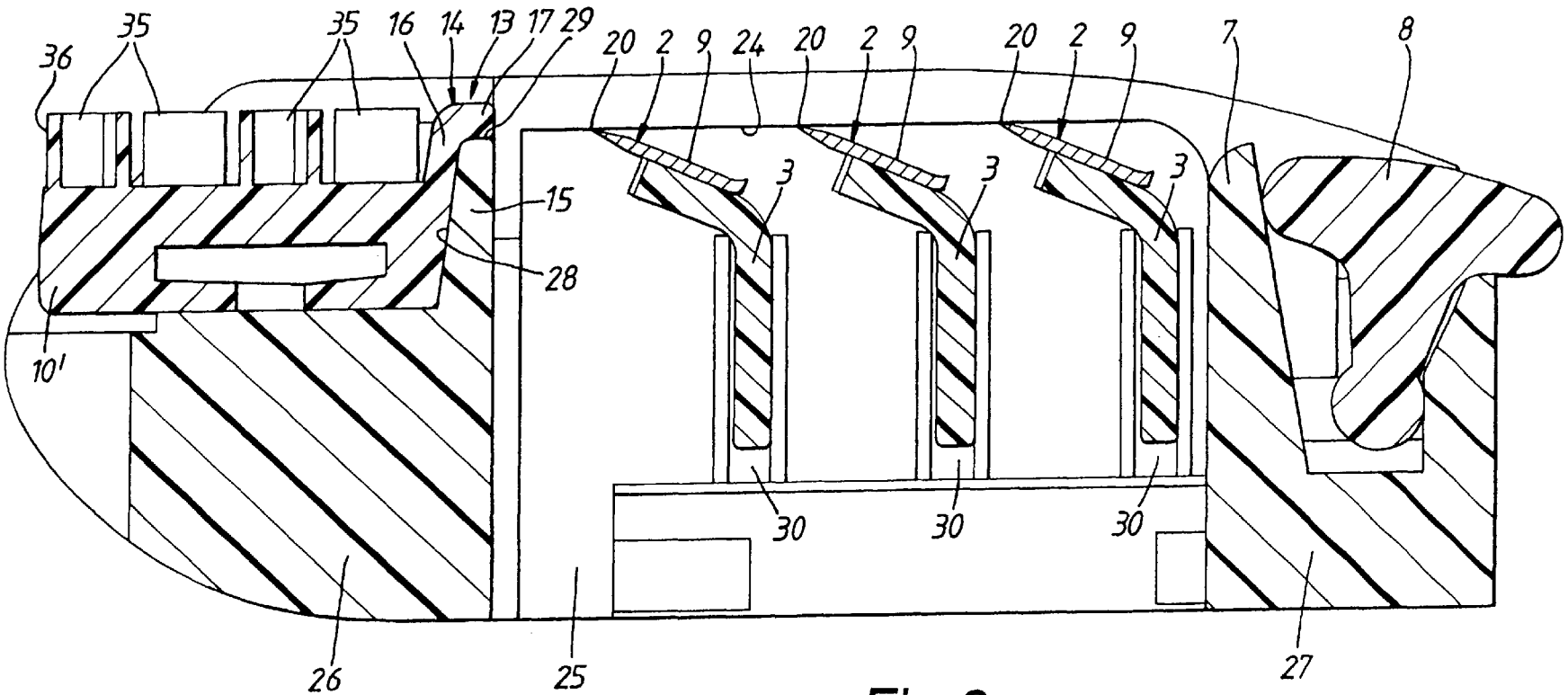
FIG. 3 is a cross-section through another safety razor blade unit with a guard structure embodying the invention.
Figure 4:
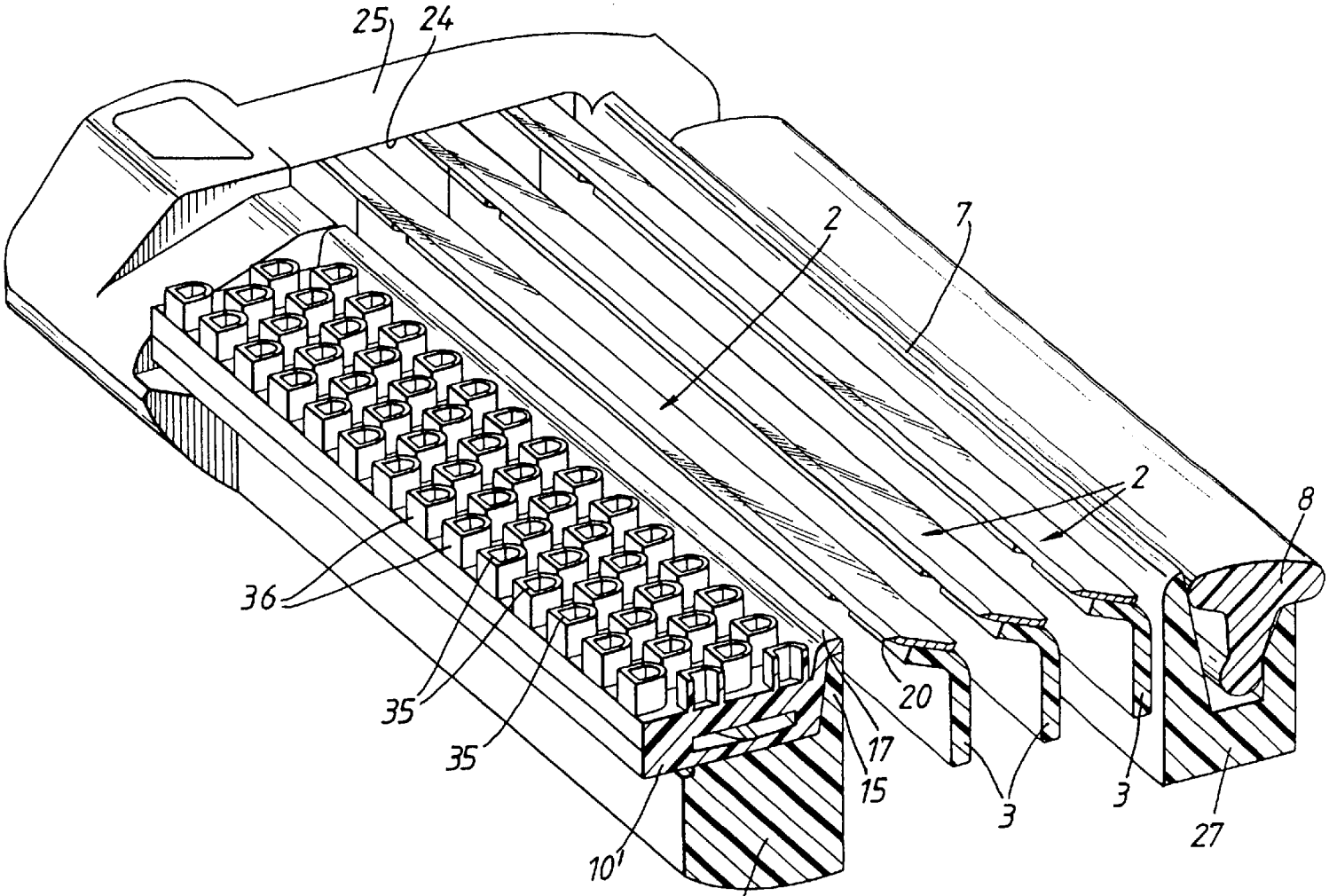
FIG. 4 is a partial isometric view of the blade unit shown in FIG. 3.

The embodiment of the invention shown in FIGS. 3 and 4 differs from that described above with reference to FIG. 1 only in the particular form of the elastomeric strip 10'. The material of the elastomeric strip 10' may be the same as mentioned in relation to the elastomeric strip 10 of FIG. 1, but rather than parallel upstanding fins the strip 10' has four rows of upwardly extending open-topped tubes 35 with D-shaped cross-sections, the tubes 35 being oriented with their flat sides 36 facing forwardly. For further information as to suitable sizes, configurations, distributions and orientations of the tubes 35 reference should be made to our international patent application No. WO97/25190, already mentioned herein above.

Figure 5A:
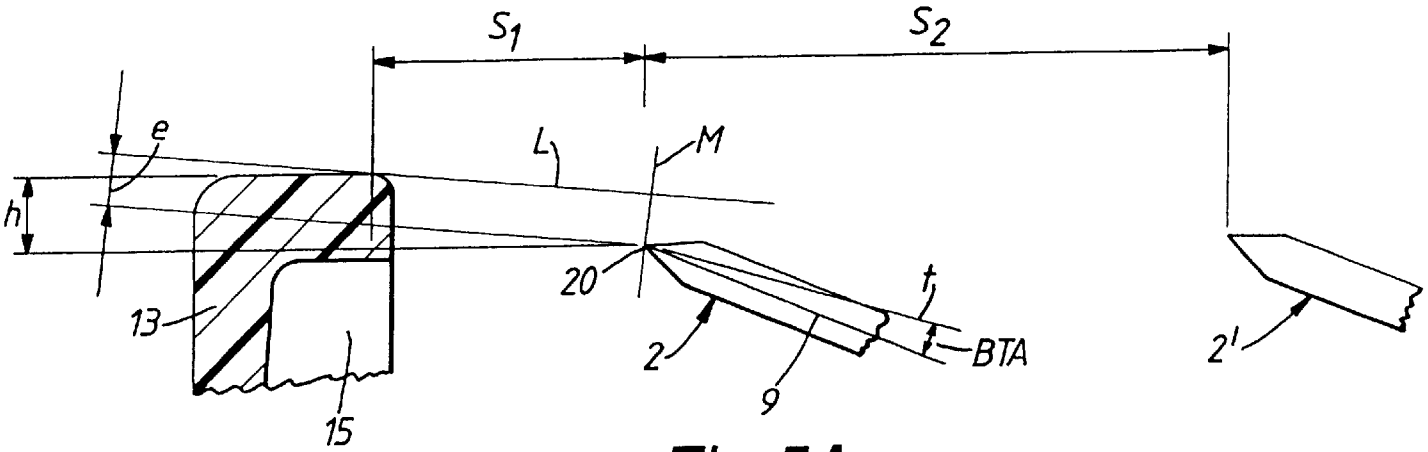
FIGS. 5A and 5B are schematic sketches illustrating how the shaving geometry may be modified by the deformable portion of the backstop yielding resiliently under shaving forces encountered during shaving.
Figure 5B:
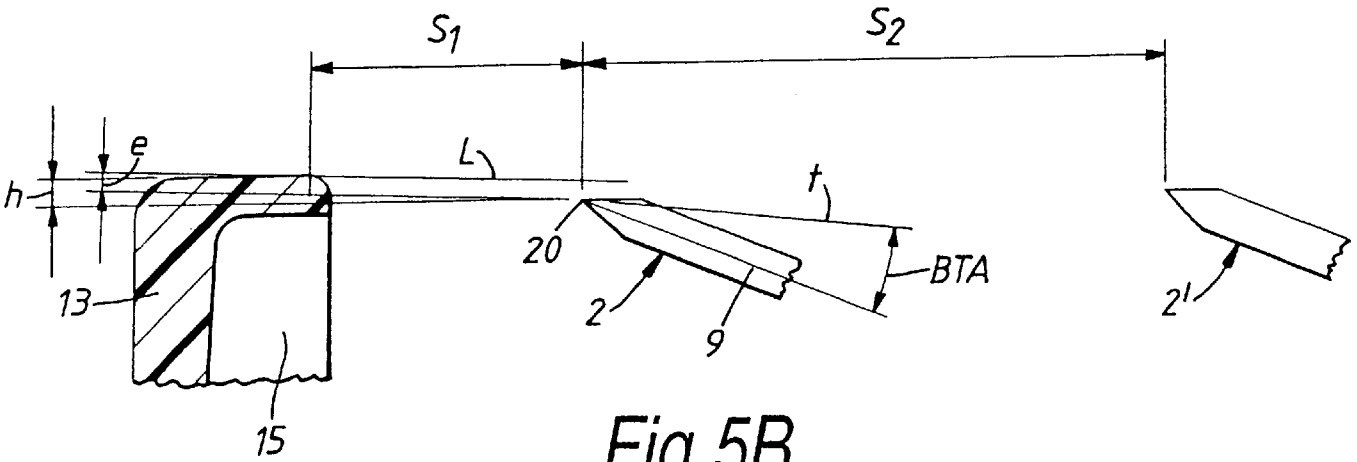

In all of the described embodiments of the invention the deformable portion of the backstop 13 defined by the lip 17 is adapted to yield resiliently under forces which may be exerted on the lip 17 by the skin during shaving, in the case of the embodiments of FIGS. 1,3 and 4 the yielding being due to the material of the lip being compressed, and in the case of the FIG. 2 embodiment the yielding resulting from the lip flexing and possibly being compressed subsequently. In all cases the yielding of the deformable portion 17 under forces associated with shaving results in the shaving geometry, especially the parameters relating to the first blade being modified. The manner in which the shaving geometry is affected by the deformable portion yielding is illustrated in FIGS. 5A and 5B which show schematically the spatial relationship of the first blade 2 with the backstop 13 of the guard and the second blade 2', the deformable portion being represented in a normal undeformed condition in FIG. 5A and in a condition of typical yielding as occurs during shaving in FIG. 5B. In the initial condition of FIG. 5A, the backstop 13 projects above the level of the blade edge 20 by a height h of 0.20 mm, the first blade 2 has a negative exposure e of −0.14 mm and the blade tangent angle BTA (the angle at which the plane in which the main body 9 of the blade 2 lies, as opposed to the plane of the facets of the tip portion of the blade, intersects a plane t tangential to the blade edge 20 and to the skin engaging surface next in front of the blade edge) of the first blade is 6.6°. Exposure e is the distance that the tip of the blade in question lies above (positive exposure) of below (negative exposure) the line L extending from the skin engaging surface next in front of to that next behind the blade whose exposure is being measured. Exposure is measured along the line M drawn from the tip of the blade in question to the line L in FIG. 5. When the deformable portion of the backstop has yielded by compression and/or deflection to the position represented in FIG. 5B, the height h of the backstop above the level of the edge 20 of the first blade 2 is reduced to 0.07 mm, with the consequence that the negative exposure of the blade reduces to −0.05 mm, and the blade tangent angle is increased to 16.8°, both effects resulting in a more aggressive engagement of the first blade 2 with the skin being shaved due to the razor being pressed with greater force against the skin. In the particular example of FIG. 5 it is assumed that the blades are fixed with the blade span $S_1$ of the first blade being 0.7 mm and the span $S_2$ of the second blade being 1.5 mm, and if the blades are themselves capable of movement under forces imposed during shaving, as they are in the specific embodiments described above, the changes in shaving geometry brought about by the resilient yielding of the deformable portion of the blade backstop 13 would vary accordingly.

The invention provides an especially convenient way of securing the advantages of a guard backstop without complication of the blade unit manufacture and assembly. One possible modification to the blade unit described above is for the support platform 18 to be integrally moulded with the frame 1, and the elastomeric strip 10 to be moulded in situ onto the platform. Whilst it is apparent that other modifications and changes can be made within the spirit and scope of the present invention, it is our intention, however, only to be limited by the appended claims.

What is claimed is:

1. A guard for a safety razor blade unit, said unit having a rigid plastic housing to provide support for at least one blade and a cap structure, said guard comprising:

an elastomeric strip disposed on said housing; and a backstop disposed on said housing between said elastomeric strip and a leading blade edge, said backstop including a rigid portion extending upwardly from said housing and a deformable portion capable of yielding resiliently under forces experienced during shaving; and wherein said deformable portion is supported against displacement in a direction towards the leading blade edge by said rigid portion of the backstop; and said deformable portion includes a lip extending over the top of said upwardly extending rigid portion, said lip being yieldable under the forces experienced during shaving to reduce the height of said backstop.

2. A guard according to claim 1, wherein the deformable portion is integral with the elastomeric strip.

3. A guard according to claim 2, wherein the lip of the deformable portion yields under shaving forces by being deflected.

4. A guard according to claim 2, wherein the lip of the deformable portion has a forward edge connected to the elastomeric strip, the lip being free to flex downwardly under shaving forces.

5. A guard according to claim 4, wherein the lip extends rearwardly from the upper end of an upwardly directed support portion which connects the lip to the elastomeric strip.

6. A guard according to claim 4, wherein the lip has a free trailing edge.

7. A guard according to claim 4, wherein downward deflection of the lip is limited by a stop.

8. A guard according to claim 1, wherein the rigid portion is a wall having a front face and a top face adjoining the front face, the lip of the deformable portion extending over the top face.

9. A guard according to claim 8, wherein the rigid wall is integral with the housing of the blade unit.

10. A guard according to claim 8, wherein the lip of the deformable portion is spaced above the top face of the rigid wall and is deformable by flexing downwardly.

11. A guard according to claim 8, wherein the lip of the deformable portion is in contact with the top face of the rigid wall and is resiliently compressible.

12. A guard according to claim 8, wherein the blade unit housing has a support surface on which the elastomeric strip is supported and the rigid wall is located at the rear of the support surface, the elastomeric strip having a rigid platform which secures the elastomeric strip to the support surface.

13. A guard according to claim 1, wherein the lip of the deformable portion yields under shaving forces by being compressed.

14. A safety razor having a blade unit with a guard as defined in claim 1.

15. A guard for a safety razor blade unit, said unit having a rigid plastic housing to provide support for at least one blade and a cap structure, said guard comprising:

an elastomeric strip disposed on said housing; and a backstop disposed on said housing between said elastomeric strip and a leading blade edge, said backstop including a rigid portion and a deformable portion capable of yielding resiliently under forces experienced during shaving; and wherein said rigid portion is a wall having a front face and a top face adjoining the front face, the lip of the deformable portion extending over the top face and being connected to the elastomeric strip by a part extending upwardly from said elastomeric strip and in contact with at least an upper portion of the front face of the rigid wall; and said deformable portion includes a lip extending over the top of said rigid portion, said lip being yieldable under the forces experienced during shaving to reduce the height of said backstop.

16. A guard according to claim 15, wherein said deformable portion is supported against displacement in a direction towards the leading blade edge by said rigid portion of the backstop.

* * * * *